United States Patent [19]

Edgerton et al.

[11] 4,412,096

[45] Oct. 25, 1983

[54] COMBINATION EARMOLD AND RECEIVER ADAPTER

[75] Inventors: Bradly J. Edgerton, Pico Rivera; William F. House, Whittier; Robert C. Michaels, Santa Barbara, all of Calif.

[73] Assignee: Minnesota Mining and Manufacturing Company, St. Paul, Minn.

[21] Appl. No.: 219,896

[22] Filed: Dec. 24, 1980

[51] Int. Cl.[3] ..... H04R 25/02

[52] U.S. Cl. ..... 381/60; 179/107 E; 179/182 R; 181/130

[58] Field of Search ..... 179/107 R-107 S, 179/1 N, 182 R; 181/130, 134, 135, 137

[56] References Cited

U.S. PATENT DOCUMENTS

| | | | |
|---|---|---|---|
| 3,921,756 | 11/1975 | Johnson | 181/135 |
| 4,010,820 | 3/1977 | Johnson | 181/135 |
| 4,091,067 | 5/1978 | Kramer et al. | 179/107 E X |
| 4,130,741 | 12/1978 | Gottlieb | 179/107 E |

OTHER PUBLICATIONS

Samuel F. Lybarger, B.S., "Earmolds," Chapter 42, pp. 508-523.

Myron H. Raas, "Let's Face the Facts, Good Earmold Impressions are Important," Hearing Instruments, p. 11 (Dec. 1976).

Joel M. Mynders, "Earmolds-A Key to Better Fittings, Earmold Feedback: An Alternate Solution," Hearing Instruments, pp. 8-9 (Dec. 1977).

Stanton I. Green, "Earmolds-A Key to Better Fittings, Experimentation in Earmold Ventilation," Hearing Instruments, pp. 9-11 (Dec. 1977).

D. B. Fifield, R. Earnshaw and M. F. Smither, "Earmolds-A Key to Better Fittings, A New Ear Impression Technique," Hearing Instruments, pp. 11-12 and 40-41 (Dec. 1977).

Dan F. Konkle, MA, and Fred Bess, PhD, "Custom-Made vs Stock Earmolds in Hearing Aid Evaluations," Arch Otolaryngol, vol. 99, pp. 140-144 (Feb. 1974).

John F. Orton, MEd, "Practical Aspects of Fitting In-the-Ear Aids, Part II: Dispenser Modifications," Hearing Instrument, vol. 31, No. 5, pp. 16-17 and 84 (1980).

Mead C. Killion, "Earmold Plumbing for Wideband Hearing Aids," Paper CC4, 91st Meeting of the Acoustical Society of America (Apr. 8, 1976).

Product Brochure, "Introducing . . . Receiver Adapter Rings for Silicone Earmolds by Insta-Mold," Insta-Mold Prosthetics, Inc., Philadelphia, Pennsylvania.

"Pro-Mold TM Custom Ear Protector Mold Kit," McGhan Medical Corporation, Santa Barbara, California.

*Primary Examiner*—Benjamin R. Fuller

*Attorney, Agent, or Firm*—Cruzan Alexander; Donald M. Sell; Jennie G. Boeder

[57] ABSTRACT

An acoustically sealed earmold and a receiver adapter insertable into the ear of an individual with impaired hearing and used in conjunction with an external receiver to evaluate hearing. A unique method of coupling the receiver adapter to the earmold is also disclosed. The adapter is inserted into the molded portion of the earmold and provides a straight passageway for transmission of sound energy from the receiver to the occluded space of the external canal of the ear. The device substantially reduces the problem of acoustic feedback in high gain hearing aid fittings and provides more accurate transmission of acoustic signals to allow improved hearing evaluation. This invention enables an audiologist to fit the earmold and conduct hearing aid evaluations in a single office visit.

11 Claims, 5 Drawing Figures

COMBINATION EARMOLD AND RECEIVER ADAPTER

This invention relates to the fitting of hearing aids and more particularly to an earmold and receiver adapter for use with external receivers to provide an acoustically sealed earmold, and improved hearing evaluation in a minimum of time and office visits.

One of the most difficult tasks in clinical audiology is the evaluation and fitting of high-gain hearing aids for the severely or profoundly deafened. Severely deafened individuals differ markedly in their abilities to extract information from the amplified acoustic signal. It is essential that each patient having a severe hearing loss be given a careful audiological evaluation to determine the best possible hearing aid settings and amplification system.

The conventional method of evaluating hearing aids with external receivers is to first prepare a standard custom-made earmold from, for example, Lucite® brand acrylic material, a trademark of E. I. duPont de Nemours and Co., Wilmington, Delaware, which is fit with a snap ring that will accomodate various external hearing aid receivers. This procedure involves taking an impression of the external auditory canal of the ear and sending this impression to an earmold company which makes a custom-fit earmold. It is then necessary for the individual to return to the office for fitting and evaluation of hearing aids with the custom-fit earmold. Moreover, since it is impossible to predict whether a particular impression will produce an earmold which is capable of forming an adequate acoustic seal so as to reduce feedback, a number of unsatisfactory molds may be made before an acceptable one is produced.

Having an earmold fitting procedure which allows making a custom-fit earmold and coupling it to a receiver adapter within a short time and preferably within one office visit, would greatly enhance the flexibility of fitting hearing aids, as well as reduce the amount of time spent with each patient. Presently, there is no known method for forming the earmold and evaluating hearing during a single office visit. There is, however, one method which is touted as being fast. It involves the use of an elastomeric silicone material, commercially available under the tradename "Insta-Mold", from Insta-Mold Prosthetics, Inc., Philadelphia, Pennsylvania, to form an earmold, and the coupling of the earmold to receiver adapter rings by pressing the rings into the earmold before the earmold has cured. After the earmold has cured for about 15 minutes, a hole is bored with a boring tool, through the adapter ring and out through the tip of the earmold that enters into the ear canal. Receivers are attached to the adapter rings when the earmoldd has completely cured, and hearing is evaluated. For complete curing at least a one day wait is required. If the earmold is not allowed to completely cure, interchange of external receivers will most likely separate the receiver adapter rings from the earmold. Thus, use of this method does not allow earmold fabrication and hearing evaluation in only one office visit.

The present invention provides an improved combination earmold and receiver adapter which allows a custom-fit earmold to be made and hearing aids to be evaluated within a single office visit. The combination comprises an earmold made of a flexible, elastic, fast-setting silicone material having a density after curing of about 0.5–3.0 gm/cc, and preferably 1.0 to 2.0 gm/cc, which conforms substantially to the contours of the canal of the ear and is capable of providing an accoustical seal when inserted into the ear; and a hearing aid receiver adapter inserted through the earmold, comprising a semi-rigid longitudinal conduit capable of providing a straight passageway for sound energy from a hearing aid receiver to the occluded space of the external auditory canal when the earmold is inserted in the ear, and a receiver mounting flange at one end of the longitudinal conduit, capable of allowing for easy change of receivers during a hearing evaluation process.

The structure of the unique receiver adapter allows it to be physically inserted in the earmold without waiting for the silicone material to completely cure, and allows receivers to be interchanged and tested, within about fifteen minutes of the beginning of the earmold fabrication procedure. In addition, the receiver adapter, by providing a straight passageway for sound waves, substantially reduces the degree to which the characteristic of the amplified acoustic signal are altered when the signal passes through the adapter and into the occluded space of the external auditory canal. In comparison, the adapters of the prior art comprise flexible tubing passed through a hole drilled in a stock earmold and attached to a conventional external receiver adapter which provides a right angled acoustic pathway. The effect of using such right angled passageways for sound waves is to substantially alter the characteristics of the acoustic signal leaving the receiver in a manner that is atypical with respect to a permanent earmold fitting. As a result, the hearing needs of the patient cannot be accurately evaluated.

The fast-setting flexible, elastomeric silicone materials from which the earmold is made are well known in the art. Exemplary silicone materials are commercially available under the trademark Pro-Mold®, from McGhan Medical Corp., Santa Barbarb, California and under the tradename "Insta-Mold", from Insta-Mold Prosthetics, Inc., Philadelphia, Pa. Silicone materials are known to be useful with even high gain hearing aid settings, since they provide tightly fitting but comfortable earmolds which reduce acoustic leaks and therefore, feedback problems. Feedback results when sound from the occluded space of the external auditory canal is allowed to find its way to the microphone portion of the hearing aid. Such an acoustic leak results in an annoying hum or squeal and limits the degree of amplification or gain which can be achieved. Acoustic leaks also cause attenuation of the low frequencies by introducing shunt pathways to the external air. The stock molds and putty frequently used in hearing aid evaluation usually yield unacceptable fittings since feedback is a frequently encountered problem and thus full gain potential cannot be evaluated. It is well known that hearing aid dealers and audiologists have frequently modified the desired hearing aid gain due to feedback problems. Gain settings based on acoustic feedback may produce hearing aids having no useable signal in critical frequency ranges. The use of flexible elastomeric silicone materials reduces feedback since the earmold moves with configuration changes in the ear canal caused by movement of the jaw, and returns simultaneously to its original shape before sound leakage can occur.

The present invention employs in a preferred embodiment a fast and simplified method of coupling the receiver adapter to the earmold. The preferred method can be accomplished in one or two minutes.

The influence of earmold acoustics on the outcome of hearing aid fittings is widely recognized. The earmolds of the present invention are not normally utilized as permanent earmolds. However, since they are acoustically consistent with more permanent non-vented full earmolds, they enable better fittings and hearing evaluations to be made. The earmold and adapter of the present invention do not vary significantly from a permanent earmold fitting with respect to frequency response. Behavioral threshold measurements have revealed differences no greater than 5 decibels for frequencies from about 250 to 8000 Hz for permanent custom earmolds and the earmold and receiver adapter of the present invention.

In summary, a combination earmold and receiver adapter is described which has the advantage that it requires little clinical time to obtain an acceptable earmold which can be used immediately with the receiver adapter and an external receiver to evaluate hearing loss. In addition, the device of the present invention substantially reduces the problem of acoustic feedback in high gain hearing aid fittings and provides more accurate transmission of acoustic signals to allow improved hearing evaluation.

BRIEF DESCRIPTION OF THE DRAWINGS

The invention will now be described in more detail with reference to the following drawings in which.

DESCRIPTION OF THE PREFERRED EMBODIMENT

The earmold portion of the device is a fastsetting flexible silicone material which is relatively dense, i.e., has a density of about 0.5–3.0 gm/cc, preferably about 1.0–2.0 gm/cc, and is capable of producing a good acoustic seal when inserted in the ear, i.e., the outer surface of the earmold is not porous. It has been found that silicone materials having this range of densities after curing provide earmolds having reduced acoustic feedback. Preferably the flexible fast-setting silicone material cures at room temperature in about 1 to 30 minutes. A preferred fast-setting silicone is commercially available under the trademark Pro-Mold ®, from McGhan Medical Corporation, Santa Barbara, California. Pro-mold ® brand silicone material is a two-part, high viscosity, room-temperature vulcanizing silicone material. One part (Part A) contains:

100.00 parts by weight of a dimethyl vinyl chainstopped polydimethyl siloxane copolymer having the formula

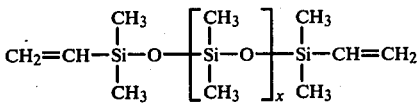

wherein x is between about 1500 and 3000;

27.00 parts by weight silica filler;

130.00 parts by weight calcium carbonate filler;

10.00 parts by weight mineral oil;

4.00 parts by weight of a hydride containing trimethyl endblocked polysiloxane having the formula

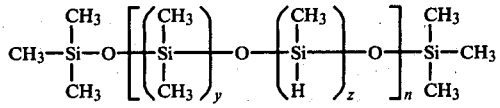

wherein y is between about 0.5 and 0.8, z is between about 0.2 and 0.5, n is between about 40 and 60; and methyl vinyl cyclics, as required to obtain an appropriate working time, normally less than 1 part by weight.

The second part (Part B) contains:

100.00 parts by weight of the same dimethyl vinyl chainstopped polydimethyl siloxane copolymer contained in Part A;

27.00 parts by weight silica filler;

130.00 parts by weight calcium carbonate filler;

10.00 parts by weight mineral oil;

0.55 parts by weight red silica pigment; and 0.15 parts by weight of a platinum catalyst prepared by dissolving 20 parts by weight chloroplatinic acid in 40 parts by weight divinyl tetramethyl disiloxane and 100 parts by weight divinyl tetramethyl disiloxane, filtering this solution and mixing 50 parts by weight of the filtrate with 100 parts by weight vinyl endblocked dimethyl polysiloxane.

Parts A and B are combined in a 1:1 by weight ratio to form the preferred earmold material.

Pro-Mold ® brand silicone material has a curing time at room temperature of about 10 to 20 minutes, and a density once cured of about 1.5 gm/cc. Other flexible fast-setting silicones such as dental impression material and "Insta-Mold" brand silicone material can also be satisfactorily utilized.

The earmold is formed by conventional methods. For example, the silicone material is mixed and inserted directly into the external auditory canal. Upon curing, the mold material hardens to a flexible mold that retains the shape of the recipient's ear.

Figure 1:
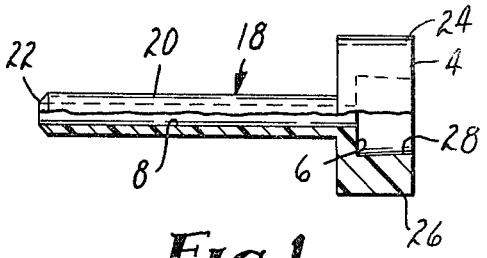
FIG. 1 is an elevational view, partially in section, of the receiver adapter of the present invention.

After removal of the earmold from the patient's ear the receiver adapter is physically inserted into the earmold. Referring now to the drawings, there is shown in FIG. 1 a receiver adapter 18 of the present invention. The adapter is preferably fabricated from a polymeric semi-rigid material. The preferred adapter material is Teflon ® brand fluorocarbon material available from E. I. duPont de Nemours and Co., Wilmington, Delaware. This material is preferred since it is flexible enough to conform to most ear canal anatomies.

Receiver adapter 18 comprises a longitudinal conduit 20, beveled at one end 22, to insure easy insertion into the earmold, and having a receiver mounting flange 24 at the opposite end. The longitudinal conduit has a central opening 8 adapted for transmission of sound energy. The inside diameter of conduit 20 must be large enough to transmit unaltered acoustic signals. Preferably the conduit 20 has an outside diameter of up to about 3.5 mm and an inside diameter of between about 2.0 and 3.2 mm, with an outside diameter of about 3.1 mm and an inside diameter of about 2.0 mm being particularly preferred, to facilitate the transmission of an unaltered acoustic signal. The diameter of conduit 20 should not be so large as to interfere with the ability of the earmold, into which conduit 20 is inserted, to fit snuggly in the ear.

The receiver mounting flange 24 is of a size and shape which facilitates easy changing of receivers during the hearing evaluation process. In the preferred embodiment shown, the receiver mounting flange 24 has a cylindrical outer surface 26 and a socket 28 communicating with the central opening 8 of conduit 20. The socket 28 has the shape of a frustum, having a circular base 6 adjacent the central opening 8. The opposite end of the frustum, parallel to the base 6, is also circular and lies adjacent to outer surface 4 of the receiver adapter. However, sockets varying in shape can be utilized with advantage.

Figure 2:
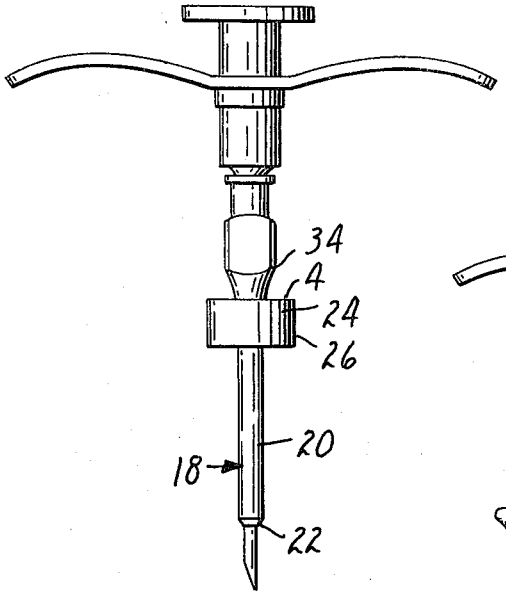
FIGS. 2 and 3 are elevational views illustrating a preferred method of coupling the receiver adapter and the earmold of the present invention.
Figure 3:
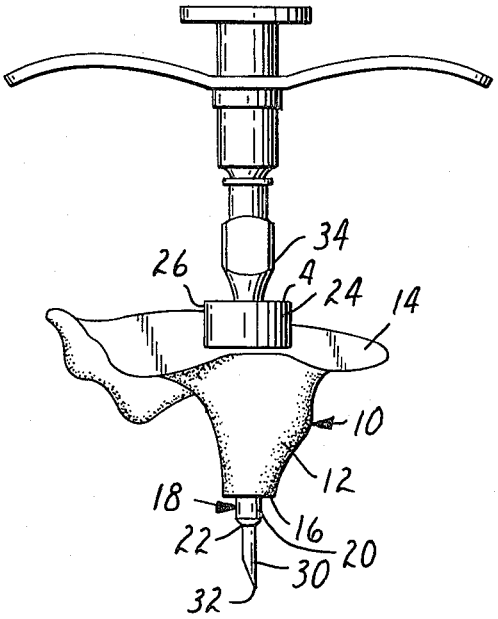

A preferred method of inserting the receiver-adapter into the earmold is by the use of a rod-like instrument which is sharp at one end, such as a needle, and has an outer diameter slightly less than the internal diameter of the longitudinal conduit of the adapter. FIGS. 2 and 3 illustrate a particularly preferred method of mounting the receiver adapter 18 in the earmold. FIG. 2 shows a standard 15 gauge catheter needle 30, available from Popper and Sons, Inc., New Hyde Park, New York, inserted through the central opening 8 in longitudinal conduit 20. The sharp end 32 of the needle 30, protrudes from the beveled end 22 of the longitudinal conduit 20. The flanged end 34 of the needle 30 lies adjacent the receiver mounting flange 24 of the adapter, and prevents the needle from passing entirely through the longitudinal conduit.

FIG. 3 illustrates the catheter needle 30 and adapter 18 pushed through the earmold 10. The earmold 10 has an outer surface 12 shaped such that it will conform substantially to the contours of the external auditory canal of the patient's ear when inserted therein. The earmold 10 has an outer ear surface 14, adjacent the receiver mounting flange 24, and an inner ear surface 16, which when inserted in the ear, is closest to the occluded space of the external auditory canal. The sharp end 32 of the needle 30, carrying the adapter 18, is first inserted in the outer ear portion 14 of the earmold. The sharp end 32 of the needle 30 is pushed through the earmold 10 and exits at the inner ear surface 16 of the earmold. The beveled end 22 of the adapter 18 also exits the earmold 10 at the inner ear portion 16. The receiver mounting flange 24 prevents the longitudinal conduit 20 of the adapter 18 from passing entirely through the earmold, much like the flange 34 of the needle 30 prevents it from passing entirely through the longitudinal conduit 20. After insertion, the receiver mounting flange 24 lies adjacent the outer ear portion 14 of the earmold. It is preferred that the longitudinal conduit 20 of the adapter 18 be positioned centrally in the earmold 10. If the rigid longitudinal conduit 20 lies too close to the surface of the earmold 12, it may prevent the earmold from following the contours of the ear canal, creating a slit leak and concomitant acoustic feedback. After the adapter is properly positioned in the earmold 10, the needle 30 is withdrawn by pulling it back through the longitudinal conduit 20 so that it exits from the receiver mounting flange 24, leaving the adapter 18 embedded in the earmold 10.

Figure 4:
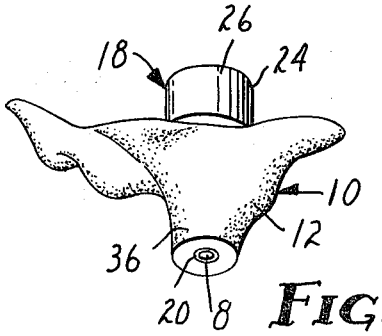
FIG. 4 is a perspective view of one embodiment of the combination earmold and receiver adapter of the present invention.

The final step of the procedure is to trim the portions of the earmold 10 and adapter 18 which extend furthest into the ear canal to the proper length using a scissors or razor blade. It is preferred, when the earmold is formed from Pro-Mold® brand silicone material, that the earmold be trimmed so that a small lip is left on the earmold just medial to the point corresponding to the beginning of the ear canal proper. It has been found that this lip results in reduced acoustic leakage. FIG. 4 shows one embodiment of the finished earmold and receiver adapter after the beveled end 22 of the longitudinal conduit 20 and the inner ear portion 16 of the earmold 10 have been properly trimmed. The earmold is fabricated from Pro-Mold® brand silicone material and has a small lip 36 formed therein.

It has been found that coupling the receiver adapter 18 and earmold 10 in the preferred manner provides the coupled structure with a slightly increased ear canal diameter. This slightly increased ear canal diameter provides that the structure has even a tighter fit in the ear, thereby further reducing the possibility of acoustic feedback.

Figure 5:
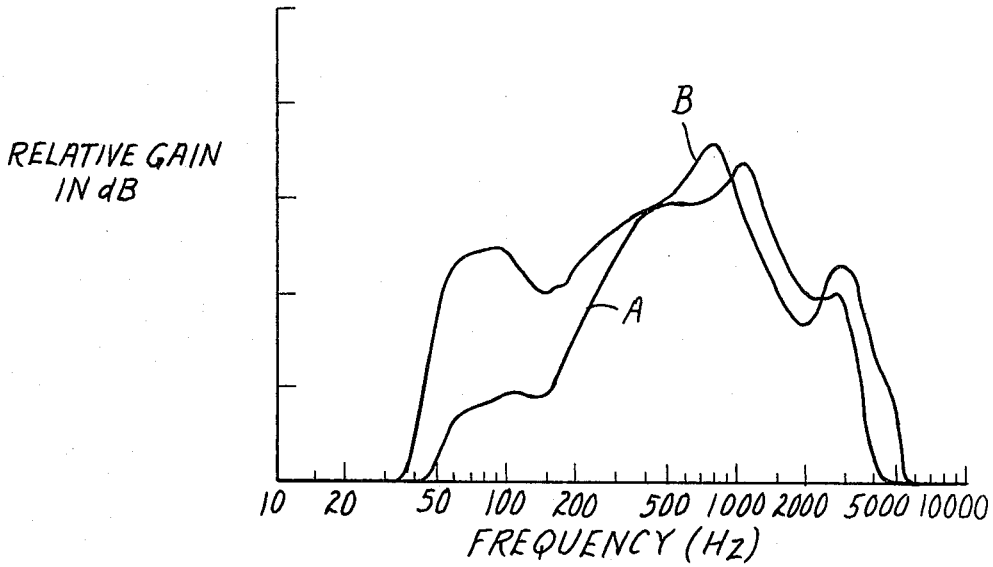
FIG. 5 is a graphic representation comparing the frequency response of a device of the prior art and the device of the present invention.

FIG. 5 provides electroacoustic frequency response curves for the adapter of the present invention which provides a straight passageway for the transmission of sound waves between the receiver and the occluded space of the external auditory canal, and a receiver coupling system which utilizes standard double walled tubing connected to a receiver adapter which provides a right angled acoustic pathway. Curve A represents the frequency response of an earmold and receiver adapter of the present invention, utilizing Pro-Mold® brand silicone material as the earmold material. Curve b represents the frequency response of a standard double walled tubing, right-angled adapter system inserted in a Pro-Mold® brand silicone earmold. The length of the tubing was equal to the length of the longitudinal conduit of the receiver adapter of the present invention. The tubing is standard #13 tubing having an internal diameter of 2.16 mm. The hearing aid receiver used was a Bosch body hearing aid made by the Robert Bosch Co., Berlin, Germany, and commercially available from Lehr Instrument Corp., Huntington Station, New York. The input was a 60 decibel sound pressure level. As illustrated, the adapter of the present invention differs substantially from that of the standard tubing and right-angled adapter system. The adapter of the present invention provides a frequency response which is more like that of a permanent earmold fitting. The standard tubing, right-angled adapter system has significant low frequency resonance between about 30 and 150 Hz, which results in an excessive amount of annoying noise. Thus, the standard tubing, right-angled adapter system varies significantly from a permanent earmold fitting with respect to frequency response, particularly at low frequencies.

The combination earmold and receiver adapter was evaluated on severely hearing impaired patients. In three of these cases, previous attempts to evaluate hearing using custom made Lucite® brand acrylic earmolds proved unsuccessful due to acoustic feedback. Experience with over 20 severe-to-profound sensori neural hearing impaired patients revealed no cases that could not be fit with the feedback free earmold and receiver adapter system of the present invention. It is clear that the combination earmold and receiver adapter of the present invention is highly useful for evaluation of patients requiring high levels of acoustic gain. In addition, in only two cases was it necessary to obtain a second earmold to provide an acoustically sealed fit. In most cases the practice of the present invention required only about 15 minutes to obtain a system having satisfactory fit. In all cases only one patient visit was required to obtain a thorough evaluation of hearing needs.

We claim:

1. A combination earmold and receiver adapter for insertion in the external auditory canal of the ear and for use in fitting and evaluating hearing aids comprising:

an earmold comprising a flexible, elastic, fast-setting silicone material having a density after curing of about 0.5 to 3.0 gm/cc, said earmold conforming substantially to the contours of said external auditory canal of said ear; and capable of providing an accoustical seal when inserted in said external auditory canal;

a hearing aid receiver adapter inserted through said earmold, said receiver adapter comprising a semi-rigid longitudinal conduit, said longitudinal conduit capable of providing a straight passageway for sound energy from an external receiver to the occluded space of said external auditory canal of said ear when said earmold is inserted in said external auditory canal, and a receiver mounting flange, at one end of said longitudinal conduit, capable of allowing easy change of receivers during a hearing evaluation process.

2. The combination of claim 1 wherein said flexible fast-setting silicone material has a curing time of about 1 to 30 minutes.

3. The combination of claim 1 wherein said flexible, elastic, fast-setting silicone material comprises a two-pat, room temperature valucanizing silicone material; wherein one part comprises a dimethyl vinyl chain-stopped polydimethyl siloxane copolymer and a hydride containing trimethyl endblocked polysiloxane; and wherein said second part comprises a dimethyl vinyl chainstopped polydimethyl siloxane copolymer and a platinum catalyst.

4. The combination of claim 1 wherein said receiver adapter is molded from a flexible polymeric semi-rigid material.

5. A method of assembling a combination earmold and receiver adapter, said combination comprising a flexible, elastic earmold and a receiver adapter comprising a semi-rigid longitudinal conduit having a receiver mounting flange at one end thereof, comprising the steps of (a) inserting a rod-like instrument into said receiver mounting flange and through said longitudinal conduit of said receiver adapter, said rod-like instrument being sharp at one end and having means for preventing said rod-like instrument from passing entirely through said longitudinal conduit of said receiver adapter at the opposite end, and said rod-like instrument having an outer diameter slightly less than the inner diameter of said longitudinal conduit;

(b) pushing said sharp end of said rod-like instrument through said earmold, said rod-like instrument carrying said receiver adapter therewith, until said longitudinal conduit of said receiver adapter provides a passageway entirely through said earmold;

(c) removing said rod-like instrument from said receiver adapter by pulling said rod-like instrument back through said longitudinal conduit so that it exits from said receiver mounting flange.

6. The method of claim 5 wherein said rod-like instrument is a needle, and wherein said means for preventing said rod-like instrument from passing entirely through said longitudinal conduit is a flange.

7. The method of claim 6 additionally comprising the step of (d) trimming the portions of said earmold and said longitudinal conduit which are to extend furthest into the external auditory canal of the ear when said combination is inserted into said external auditory canal.

8. A method of elvaluating a hearing impaired patient's response to various settings of receivers comprising the steps of:

(a) casting an earmold from an ear of said hearing impaired patient, said earmold coprising a flexible, elastic fast-setting silicone material having a density after curing of about 0.5 to 3 gm/cc and capable of providing an acoustical seal when inserted in said ear of said patient;

(b) inserting through said earmold a semi-rigid longitudinal conduit of a receiver adapter; said receiver adapter comprising said semi-rigid longitudinal conduit, capable of providing a straight passageway for sound energy from an external receiver to the occluded space of the external auditory canal of said ear when said earmold is inserted in said external auditory canal, and hving a receiver mounting flange for holding said external receiver at one end thereof, said flange being capable of facilitating eady change of receivers during said hearing evaluation;

(c) inserting the earmold and receiver adapter combination in the ear of said patient;

(d) mounting an external receiver on said receiver mounting flange; and (e) elvalulating said patient's response to various settings of said receiver;

(f) removing said external receiver from said receiver mounting flange; and (g) optionally repeating steps d-f, using another receiver.

9. An earmold and receiver adapter kit for use in evaluating external receiver hearing aids comprising:

a flexible, elastic, fast-setting silicone material having a density after curing of about 0.5 to 3.0 gm/cc; and a hearing aid receiver adapter, said receiver adapter comprising a semi-rigid longitudinal conduit capable of providing a straight passageway for sound energy, and having a receiver mounting flange at one end thereof, said receiver mounting flange being capable of receiving external hearing aid receivers.

10. The earmold and receiver adapter kit of claim 9 wherein said kit also comprises a rod-like instrument which has an outer diameter slightly less than the inner diameter of said longitudinal conduit, is sharp at one end, and has means for preventing it from passing entirely through said longitudinal conduit at the opposite end.

11. The earmold and receiver kit of claim 9 wherein said flexible, elastic, fast-setting silicone material is a two-part, room temperature vulcanizing silicone wherein one part comprises a dimethyl vinyl chainstopped polydimethyl siloxane copolymer and a hydride containing trimethyl endblocked polysiloxane; and wherein said second part comprises a dimethyl vinyl chainstopped polydimethyl siloxane copolymer and a platinum catalyst.

* * * * *